United States Patent [19]

Fujiwara

[11] 3,986,183

[45] Oct. 12, 1976

[54] BURGLAR ALARM

[76] Inventor: Akinobu Fujiwara, 3204 Shimohatsukari, Hatsukari, Otsuki, Yamanashi 409-11, Japan

[22] Filed: June 3, 1975

[21] Appl. No.: 583,397

[30] Foreign Application Priority Data

Feb. 17, 1975 Japan ..... 50-21647[U]

[52] U.S. Cl. ..... 340/276; 340/274 R; 340/384 R; 335/266; 200/61.19

[51] Int. Cl.[2] ..... G08B 13/08

[58] Field of Search ..... 340/274, 276, 283; 200/61.19, 61.81; 335/17, 219, 266

[56] References Cited

UNITED STATES PATENTS 3,896,427 7/1975 Campman ..... 340/274

*Primary Examiner*—John W. Caldwell
*Assistant Examiner*—William M. Wannisky
*Attorney, Agent, or Firm*—Wenderoth, Lind & Ponack

[57] ABSTRACT

A burglar alarm has a sound generating circuit which is actuated when the two magnets are moved away from each other. The sound generating circuit includes two coils of wire wound on a common core, and a permanent magnet hammering device which is actuated by the coils for sounding. When the two magnets are moved away from each other, a switch closes so that intermittent current can flow through one of the coils which repels the hammering device for sounding and releases it under the action of the other coil.

1 Claim, 3 Drawing Figures

BURGLAR ALARM

BACKGROUND OF THE INVENTION

This invention relates to a burglar-alarm of reduced dimensions, and more particularly to improvement in the buzzer alarm which includes a buzzing circuit having electrically-energized coils actuating a vibrator without electrical contacts, and a magnet-actuated switching circuit. Despite its compact size, the alarm can produce buzzing sounds of high pressure and loud enough to scare off burglars.

There are known various buzzer alarms which can protect a house from burglary. A known buzzer alarm can provide loud sounds, but must be built with relatively increased dimensions. A buzzer alarm of reduced dimensions is also known, but it is practically useless because of its limited sound pressure. As noted above, an alarm which is capable of producing loud sounds must be built with relatively increased dimensions which limits the location in which it can be installed, and it is very easily discovered by burglars. This gives burglars opportunities of taking counter-measures or rendering the alarm inoperative or useless before they break in. The known alarm of reduced dimensions may be installed so as to be difficult to see, but it cannot provide sounds having a loudness which can scare off burglars.

SUMMARY OF THE INVENTION

It is therefore one object of the present invention to provide a burglar-alarm of reduced dimensions but capable of producing buzzing sounds having loudness which can scare off burglars.

It is another object of the present invention to provide a burglar-alarm which can be installed at any desired location of the house and without limitations so inconspicious that burglars cannot tamper with the alarm.

A more particular object of the present invention is to provide a burglar-alarm which can produce high-pressure sounds of about 60 to 70 phons despite its compact size, and which comprises a buzzing circuit having electrically-energized coils actuating a vibrator without electrical contacts, and an electrical switching in series circuit with the buzzing circuit and including a power source and a magnet-actuated switch.

It is a further object of the present invention to provide a burglar-alarm in which very small-size permanent magnets are provided which can actuate the switch, and which therefore can be installed inconspiciously anywhere through the house.

It is a still further object of the present invention to provide a burglar-alarm which has overcome all the disadvantages of prior art devices described earlier.

Other objects and advantages will become apparent from the following specification and accompanying drawings.

DESCRIPTION OF THE PREFERRED EMBODIMENTS

Figure 1:
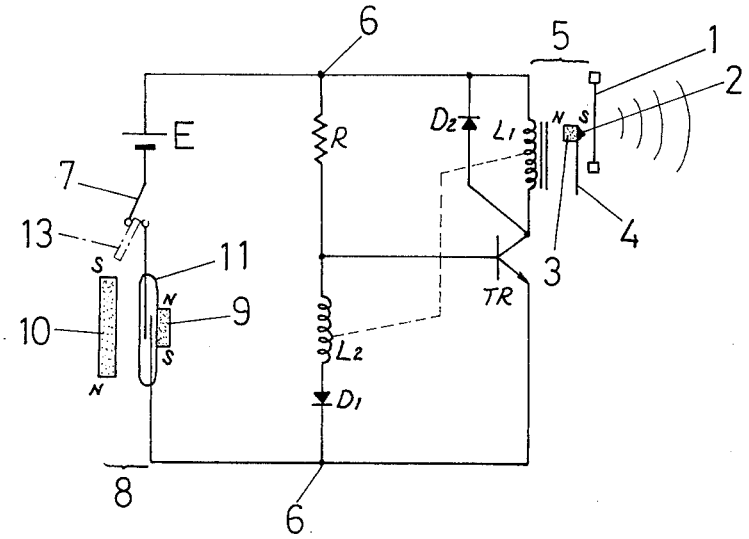
FIG. 1 is a circuit diagram of a burglar-alarm according to the invention.

The present invention will further be described by way of several preferred embodiments thereof by reference to the accompanying drawings in which:

Referring first to FIG. 1, there is provided a buzzing circuit 5 which is actuated without electrical contacts for producing buzzing sounds, and which comprises a vibrator 1 in the form of a plate member of synthetic resin material such as Mylar (registered trademark), a vibratory rod member 4 having a hammering projection 2 opposite the vibrator 1 and having a repulsory permanent magnet 3 secured thereto, and an electrically-energized coil $L_1$ provided opposite the magnet 3 for actuating the magnet 3.

More particularly, the buzzing circuit 5 includes a diode $D_2$ connected in parallel with the coil $L_1$, a transistor TR the collector of which is connected to one terminal of the coil $L_1$, a resistor R one terminal of which is connected to the other terminal of the coil $L_1$, an electrically-energized coil $L_2$ one terminal of which is connected to the other terminal of the resistor R, and a diode $D_1$ the anode of which is connected to the other terminal of the coil $L_2$ and the cathode of which is connected to the emitter of the transistor TR. The junction between the resistor R and the coil $L_2$ is connected with the base of the transistor TR.

The alarm circuit or burglar-alarm according to the invention is completed by connecting a switching circuit 8 between the two input terminals 6 of the buzzing circuit 5 or points formed at the connection between the coil $L_1$ and resistor R and between the diode $D_1$ and transistor TR, said switching circuit 8 consisting of a power source E such as a mercury battery, for example, a spacer-insertion switch element 7 and a biasing permanent magnet 9 connected in series. A separate actuator magnet 10 in the form of a permanent magnet is provided which can actuate the magnet 9 for closing the contacts of reed switch 11 when it is located close to the magnet 9 and for opening the contacts if it is moved away from the magnet 9.

The switch element 7 can serve to render the alarm circuit or alarm operative or inoperative. As noted from FIG. 2, a spacer key 13 of electrically non-conductive material is insertable between the cased battery E and collector element 12 so that it can cut off the power supply. It should be noted that the objects of the invention can be achieved if other means than the switch 7 is provided as described later.

The burglar-alarm illustrated hereto operates as described hereinafter. If the actuator magnet 10 is moved away from the magnet 9 with the switch 7 closed for placing the alarm circuit in condition for operation, it causes the magnet 9 to close the switch 11, causing current from the battery E to flow through the buzzing circuit 5 and interrupted current to flow into the coil $L_1$. As the coil $L_1$ is then energized, it causes the rod member 4 to vibrate. Actuating the rod member 4 causes the projection 2 to hammer against the vibrator 1 for producing buzzing sounds.

Figure 2:
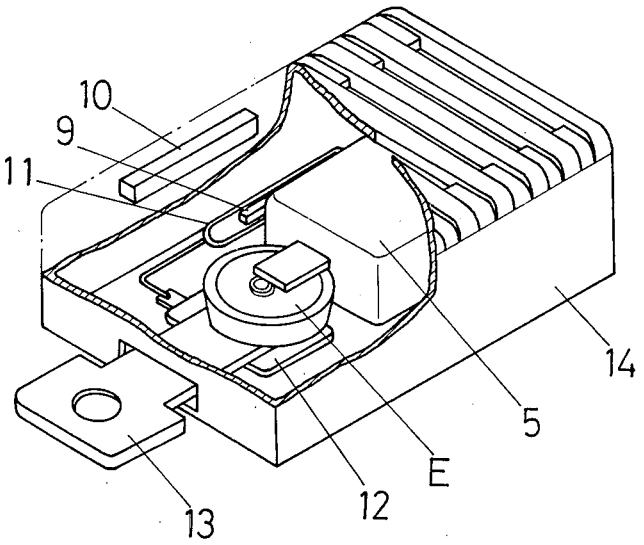
FIG. 2 is a perspective view, partly broken away, of the burglar-alarm constructed according to the invention.

The coils $L_1$ and $L_2$ may be connected as indicated by the broken lines in FIG. 2 so that the circuit can be simplified.

The function of the buzzing circuit will be described in more detail. If the actuating magnet 10 is moved away from the reed switch 11, the switch closes so that a voltage is applied across the input terminals 6. This applied voltage causes a base current to flow through resistor R into the emitter of transistor TR so that transistor TR conducts. Turning on TR causes a current from source E to flow from the collector to the emitter of transistor TR so that the coil $L_1$ is energized to repel the repulsory hammering means 4 which strikes the vibrating plate 1. In the meantime, the coil $L_2$, combined with the coil $L_1$ on a common core as indicated by the broken line, has induced therein a back-electromotive force which causes the base current to TR to be cut off, turning off transistor TR. Turning off transistor TR causes the current to the coil $L_1$ to be cut off, permitting the hammering means 4 to return to its initial position, the position where it was located before it was repelled by the coil $L_1$. As seen from the above description of the circuit, intermittent current flows through the coil $L_1$ so that the coil $L_1$ is energized intermittently, causing the hammering means 4 to be repelled at intervals for striking the sounding plate 1.

It should be noted that the principal or important elements of the alarm circuit such as buzzing circuit 5 and switching circuit 8 are of reduced dimensions, and can be assembled in a compact-size package. As shown in FIG. 2, this package can be housed in a very compact case 14 of a size: 3cm long × 2cm wide × 1cm high, for example.

The alarm manufactured according to the present invention has various fields of application, such as an alarm which triggers if a burglar breaks in, an alarm which triggers if some one approaches, and an alarm which triggers if it detects motion.

Figure 3:
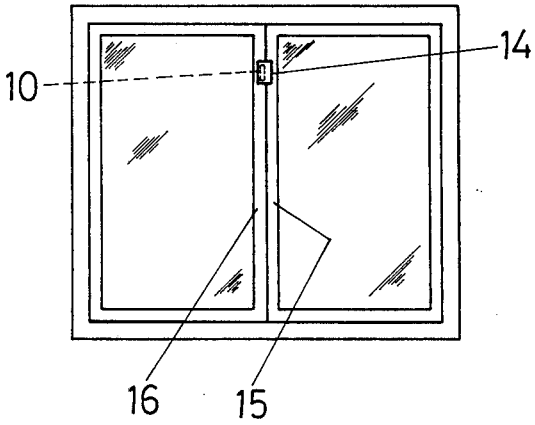
FIG. 3 is a front view of a window on which the burglar-alarm is installed.

As shown in FIG. 3, the alarm case 14 is installed on a stile 15 or vertical member of one of a hinged window frame, and the actuator magnet 10 is installed or attached to a stile 16 of the window frame. If the windows are opened, the magnet 10 is moved away from the case 14, causing the switch 11 to close so that the buzzing circuit 5 can trigger for producing warning sounds.

Because of its reduced or compact size, the alarm can be embedded in the stiles of the window frames; namely, if the alarm case 14 and the actuator magnet 10 are installed so as to be very inconspicious or not locatable to burglars, burglars will find it very difficult or impossible to locate them.

There is a further application of the alarm, in which the magnet 10 is installed inside a jewel box, and the alarm case 14 is installed in a hidden location near the jewel box, such as on a desk or in the drawer of the desk. In this application, the alarm will trigger if the jewel box is moved away from the alarm case 14.

As easily seen from the above applications, the alarm can very effectively insure against burglary.

The alarm case 14 can be disposed at any angle with respect to the actuator magnet 10 since the magnetism of the magnet 10 can influence the alarm case 14 on all four sides thereof.

If the two magnets 9 and 10 are placed opposite each other such that their magnetic lines of force flow in different directions, the switching circuit will be closed if the magnet 10 is turned on its axis.

The burglar-alarm constructed as described above has various advantages such as the compact-size construction, capability of producing buzzing sounds of high pressure, unlimited freedom of installation, and difficulty of locating it.

In the above embodiment, a mercury battery E is shown for example. However, it may be replaced by other miniature cells such as a manganese-alkaline cell, a nickel-cadmium cell or a silver-oxide cell. The spacer insertion switch 7 is shown for example, but it may be omitted if an actuator magnet and a portable suppression magnet are provided. In this case, the suppression magnet can be used as a spacer key which disconnects the switch circuit from the power source. The objects of the invention can be achieved if the suppression magnet comes near the biasing magnet so that it can cut off the power supply.

It should be understood that changes and modifications of the invention may be made without departing from the spirit and scope of the invention.

What is claimed is:

1. A burglar alarm comprising a sound generating circuit, a power source and switch means coupled to said sound generating circuit, said switch means being closed in response to the relative movement of two magnets so that current can flow from said power source into said sound generating circuit and said switch means being rendered inoperative by insertion of a non-conducting key, wherein said sound generating circuit includes first and second coils of wire wound around a common iron core, first diode means connected in parallel with said first coil, a resistor having one terminal thereof connected to one terminal of said second coil and the other terminal thereof connected to one terminal of said first coil, a transistor having the collector thereof connected to the other terminal of said first coil and having the base thereof connected between said resistor and said second coil, a second diode having the anode thereof connected to the other terminal of said second coil and the cathode thereof connected to the emitter of said transistor, repulsory hammering means having a permanent magnet moved in response to current flow in said first coil, and vibrating or sounding means actuated in response to movement of said hammering means for sounding, whereby when the two magnets are moved away from each other, said switch means is closed so that a voltage is applied across said sound generating circuit, causing base current to flow through said resistor into the emitter of said transistor, thereby making said transistor conductive so that current from the power source can flow through the collector to the emitter of said transistor, energizing said first coil to move said hammering means while at almost the same moment said second coil has induced therein a back-electromotive force which cuts off said base current through said transistor so that said current through said first coil is cut off, permitting said hammering means to return to its initial position, thus making said current through said first coil flow intermittently.

* * * * *